US012201916B2

(12) United States Patent
Madl et al.

(10) Patent No.: US 12,201,916 B2
(45) Date of Patent: Jan. 21, 2025

(54) FINGER MOUNTED SPINNING TOY

(71) Applicant: Awagama, LLC, Austin, TX (US)

(72) Inventors: Jeremy Madl, Louisburg, KS (US); Scott Wetterschneider, Austin, TX (US); Joshua Carlson, Santa Ana, CA (US)

(73) Assignee: Awagama, LLC, Austin, TX (US)

( * ) Notice: Subject to any disclaimer, the term of this patent is extended or adjusted under 35 U.S.C. 154(b) by 215 days.

(21) Appl. No.: 17/901,115

(22) Filed: Sep. 1, 2022

(65) Prior Publication Data

US 2023/0073064 A1 Mar. 9, 2023

Related U.S. Application Data

(60) Provisional application No. 63/241,138, filed on Sep. 7, 2021.

(51) Int. Cl.

| | |
|---|---|
| ***A63H 33/00*** | (2006.01) |
| ***A63H 1/00*** | (2019.01) |
| ***A63H 33/22*** | (2006.01) |

(52) U.S. Cl.

CPC ..... *A63H 33/002* (2013.01); *A63H 33/22* (2013.01)

(58) Field of Classification Search

CPC . A63H 1/00; A63H 1/24; A63H 33/00; A63H 33/22; A63H 33/26; A63H 33/002; A44C 9/0053

USPC ..... 446/26, 236, 242, 485, 491

See application file for complete search history.

(56) References Cited

U.S. PATENT DOCUMENTS

| | | | | |
|---|---|---|---|---|
| 6,776,679 | B1 * | 8/2004 | Menow | A63B 5/22 446/236 |
| 7,033,035 | B2 * | 4/2006 | Fatemi | A63H 33/22 362/800 |
| 7,361,075 | B1 * | 4/2008 | Krull | A63B 23/16 446/491 |
| 7,766,718 | B2 * | 8/2010 | Rago | A63H 1/24 446/485 |
| 9,895,620 | B1 * | 2/2018 | Walterscheid | A63H 1/24 |
| 9,914,063 | B1 * | 3/2018 | McCoskery | A63F 9/16 |
| 10,016,693 | B1 * | 7/2018 | Dowdy | B43K 29/00 |
| 10,307,687 | B2 * | 6/2019 | Umberger | A63H 33/26 |
| 10,406,450 | B2 * | 9/2019 | Howard | A63H 1/00 |
| 10,449,466 | B2 * | 10/2019 | Kinmont, Jr. | A63H 1/00 |
| 10,625,172 | B2 * | 4/2020 | Mak | A63H 33/00 |

(Continued)

FOREIGN PATENT DOCUMENTS

| | | | | |
|---|---|---|---|---|
| AT | 521645 A2 * | 3/2020 | | A63H 1/00 |
| CN | 207169034 U * | 4/2018 | | |
| WO | WO-2023218292 A1 * | 11/2023 | | A63F 9/001 |

*Primary Examiner* — Alexander R Niconovich

(74) *Attorney, Agent, or Firm* — Adam K. Sacharoff; Much Shelist, P.C.

(57) ABSTRACT

A finger mounted spinning device having an elongated housing body, preferably having a plurality of LED lights mounted into the housing body. The housing body is provided with a circular opening adjacent one end, sized such that a finger may be inserted through the opening. An annular gripping member extends inwardly within the opening, mounted to the housing body in rotational manner such that such that the elongated housing body is rotatable about the user's finger while the finger gripping member remains stationary on the user's finger. When spinning about the user's finger, the lights present a visible two-dimensional pattern.

6 Claims, 5 Drawing Sheets

(56) References Cited

U.S. PATENT DOCUMENTS

| | | | | |
|---|---|---|---|---|
| 11,002,316 | B2 * | 5/2021 | Bristow | A63H 1/00 |
| 11,400,385 | B2 * | 8/2022 | Heine | A63H 37/00 |
| 11,759,720 | B1 * | 9/2023 | Ziegler | H01F 7/0205 446/129 |
| 2018/0342930 | A1 * | 11/2018 | Roberts | H02K 7/1861 |
| 2018/0344003 | A1 * | 12/2018 | Fogelson | A45D 33/00 |
| 2018/0345155 | A1 * | 12/2018 | Philgreen | A63H 1/00 |
| 2018/0345156 | A1 * | 12/2018 | Bornstein | A63H 1/20 |
| 2018/0352829 | A1 * | 12/2018 | Diamond | A44C 9/00 |
| 2018/0353868 | A1 * | 12/2018 | Albert | A63H 1/00 |
| 2018/0369703 | A1 * | 12/2018 | Sorias | A63H 1/00 |
| 2019/0060774 | A1 * | 2/2019 | Zhong | A44C 9/0053 |
| 2019/0101160 | A1 * | 4/2019 | Bristow | F16C 35/063 |
| 2020/0171399 | A1 * | 6/2020 | Bonacum | A63H 33/00 |
| 2023/0302377 | A1 * | 9/2023 | DeStefano | A63H 1/00 |

* cited by examiner

FINGER MOUNTED SPINNING TOY

CROSS-REFERENCE TO RELATED INVENTIONS

The present invention claims priority to U.S. Provisional Application 63/241,138 filed Sep. 7, 2021 and is hereby incorporated by reference in its entirety.

BACKGROUND OF THE INVENTION

This invention relates generally to handheld toys or amusement devices, and more particularly relates to such devices that spin. Even more particularly, the invention relates generally to finger mounted spinning devices, the devices having LED lights which create visible patterns or text when the device is spun rapidly about the user's finger.

Handheld spinning devices are known, the devices comprise a hub and arms that rotate around the hub, with the hub being held between a finger and thumb of one hand and the spinning components rotated by the finger of the other hand. LED lights may be positioned within the arms. It is one object of this invention to provide an improved spinning device, one which fits onto the finger of a user rather than being held between the thumb and finger. It is a further object to provide such a device with a finger gripping structure to retain the device on the user's finger when in use. It is a further object to provide such a device with expanded visual presentation and game capabilities.

SUMMARY OF THE INVENTION

In brief summary, the invention in various embodiments is a finger mounted spinning device comprising an elongated housing body, preferably having a plurality of LED lights mounted into the housing body of the device. The housing body is provided with a circular opening adjacent one end, sized such that a finger may be inserted through the opening. An annular gripping member extends inwardly within the opening, the annular gripping member being composed of a flexible, relatively soft, rubber-like material which is sized to grip the user's finger when in use yet is able to flex over the knuckles when the finger is inserted or removed.

Preferably the annular gripping member is provided with inwardly extending projection members, such as formed for example by blunt ribs or finger-like members, or by alternating rounded peaks and valleys. The finger gripping member is mounted within a rotational assembly, such as an annular ball bearing assembly or a bushing, such that the elongated body or housing is rotatable about the user's finger while the finger gripping member remains stationary and secure on the user's finger. When the device is spun or rotated about the user's finger, the LED's present a visible two-dimensional light pattern.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
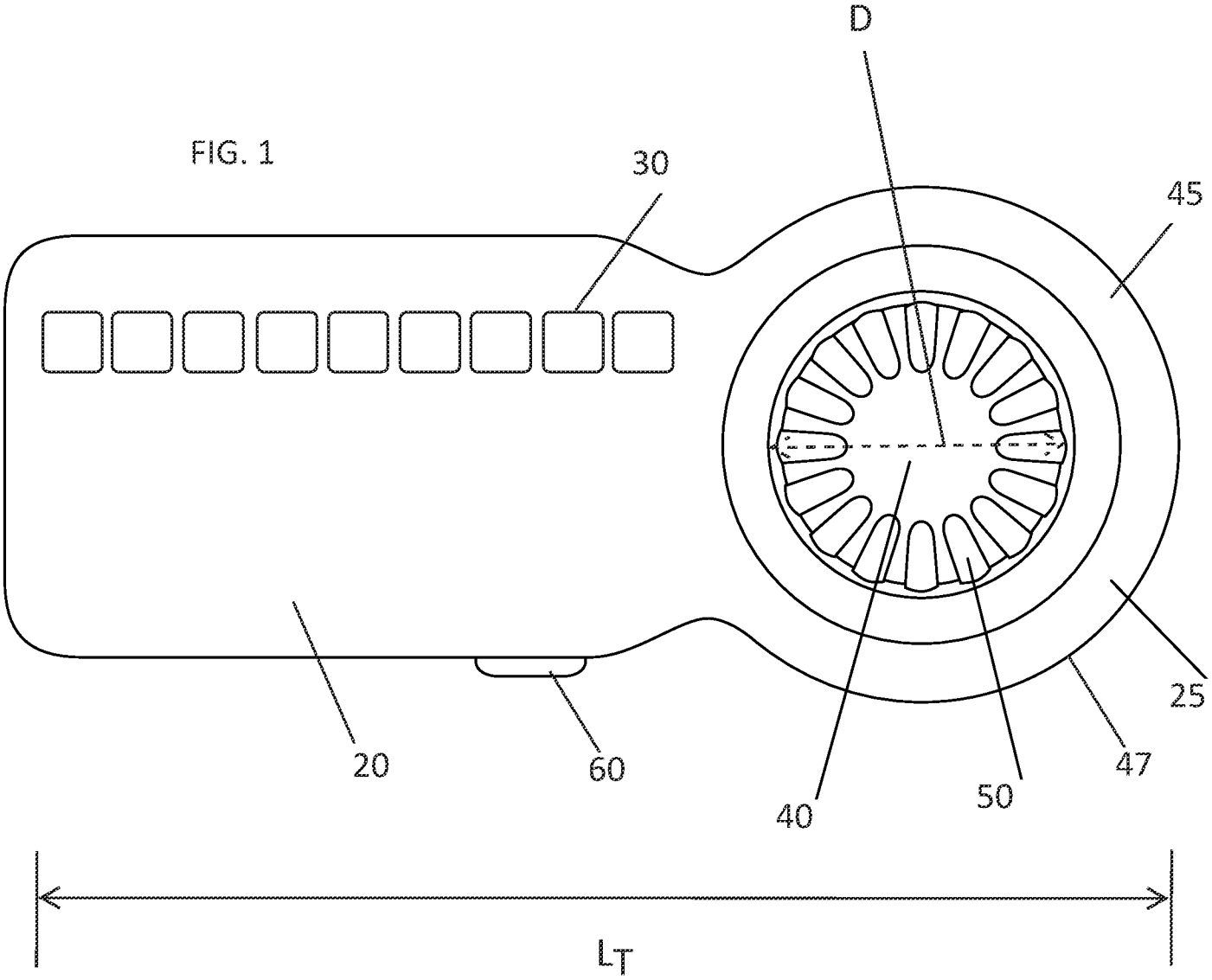
FIG. 1 is a top view of a basic representative embodiment of the invention, shown with LED lights, wherein the annular finger gripping member is mounted within a bearing.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention of the embodiments illustrated.

In general, the invention, in various embodiments, is a finger mounted spinning device comprising an elongated housing body, preferably having a plurality of LED lights mounted into the housing body of the device, the LEDs being disposed generally linearly in the longitudinal direction on the housing body at locations where they will be visible when the housing body rotates about the user's finger. The LEDs are most preferably capable of independent operation and color change, such that during rotation each LED can be turned off and on, and/or changed in color, independently of the other LEDs. The LEDs are powered by a battery and may be actuated by a manual actuation (on/off) switch or by a sensor detecting rotational movement of the device. The device is structured so as to be spun around the finger of a user.

The housing body is provided with a circular opening adjacent one end, sized such that a finger, for example the index finger, may be inserted through the opening. The outer configuration of the housing body at the end with the opening is preferably circular or rounded in configuration in order to minimize the chance of the housing body contacting the other fingers during rotation. An annular finger gripping member extends radially inwardly within the opening, the annular gripping member being composed of a flexible, relatively soft, rubber like material which is sized to securely grip the user's finger when in use yet is able to flex over the knuckles when the finger is being inserted or removed. In a basic embodiment the annual gripping member may be a ring-like member having an inner diameter smaller than the diameter of the finger opening in the housing body. Preferably the annular gripping member is provided with inwardly extending projection members, such as formed by for example ribs or finger-like projections, or by alternating rounded peaks and valleys.

The gripping member is rotatably mounted to the housing body via a rotational assembly, such that the elongated housing body is rotatable about the gripping member and the finger while the gripping member remains fixed in a stationary position on the user's finger. This may be accomplished in multiple ways, for example, such as by providing a low-friction bushing, or by providing an annular ball bearing assembly. With this structure the finger mounted spinning device is secured in place on the finger of the user while it is spinning, thereby preventing accidental release of the device during use. In addition, there is no skin irritation to the user when using the device since the annular finger gripping member remains stationary on the user's finger as the housing body is rotated.

A possible embodiment is shown in FIG. 1, which illustrates a device 10 with an elongated housing body 20, with shown LEDs 30 through the body 20. A circular opening 40 is positioned on one end 25 of the elongated housing body 20. The opening is sized to receive a finger, for example, the index finger. The outer configuration 45 of the housing body 20 at the end 25 with the opening 40 is preferably circular or rounded in configuration in order to minimize the chance of the outer edge 47 of the housing body 20 contacts the other fingers during rotation. An annular finger gripping member 50 extends radially inwardly within the opening 40 to grip the inserted finger. Lastly, an on/off switch 60 may be provided and accessible from outside of the housing body 20 to switch the LEDs on and off.

In various aspects of the embodiments, the total length (LT) of the elongated housing body may be 3 to 4 times the diameter (D) of the circular opening 40.

Figure 2:
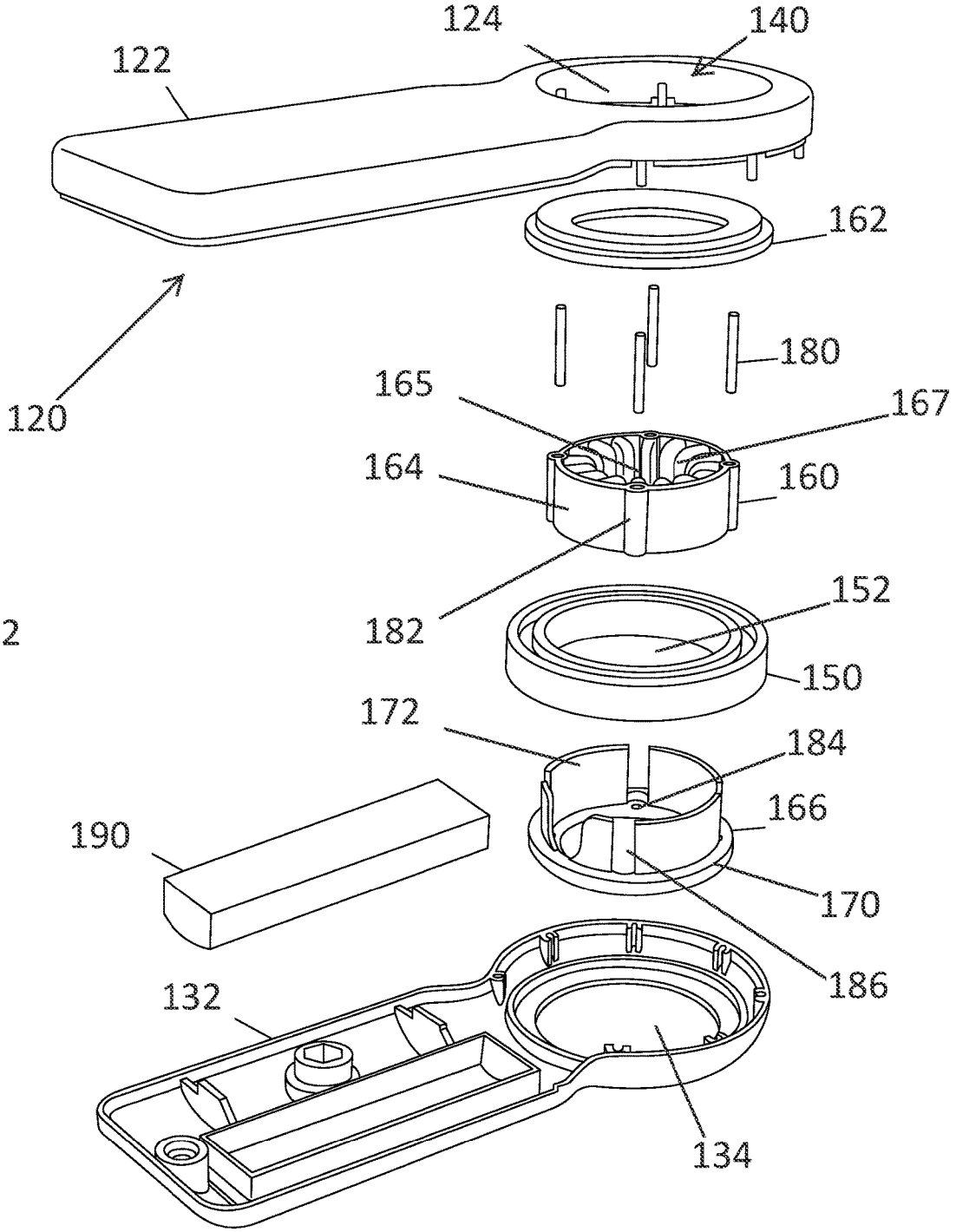
FIG. 2 is an exploded view of one representative embodiment of the invention without LED lights.

FIG. 2 illustrates another device 100 that does not include LEDs and is strictly just a figure mounted spinning toy. The device 100 includes a two-piece elongated housing body assembly 120, defined by an upper housing 122 secured to a lower housing 132. The upper and lower housings include upper and lower openings 124 and 134, respectively. When the upper and lower housings are assembled together, they form an opening 140 through one end 125 of the hosing body 120.

A bearing casing 150 is secured about the opening 140 to the housing body assembly 120. The bearing casing 150 includes a bore 152 sized to secure an annular finger ring hub 160. The ring hub 160 includes a top ring hub 162, a middle ring hub 164 and a bottom ring hub 166. The top ring hub 162 forms a cap over the middle ring hub 164 and bearing casing 150. The middle ring hub 164 includes an opening 165 through the ring hub 160 and is sized to receive the finger. An annular finger gripping member 167 are secured within the middle ring hub 164 opening 165. The bottom ring hub 166 includes an outward extending shoulder 170 and an upwardly extending skirt 172 to capture the middle ring hub 164 within the skirt and allow the bearing casing 150 to rest on the outward extending shoulder 168. Lastly, support pins 180 are positioned through shafts 182 positioned around the outside of the middle ring hub 164 and secured to holes 184 in the bottom ring hub 166. The shafts 182 are positioned in channels 186 cut into the upwardly extending skirt 172 of the bottom ring hub 166.

Lastly, a weight 190 is positioned in the two-piece elongated housing body assembly 120 to help ensure the device spins properly.

Figure 3:
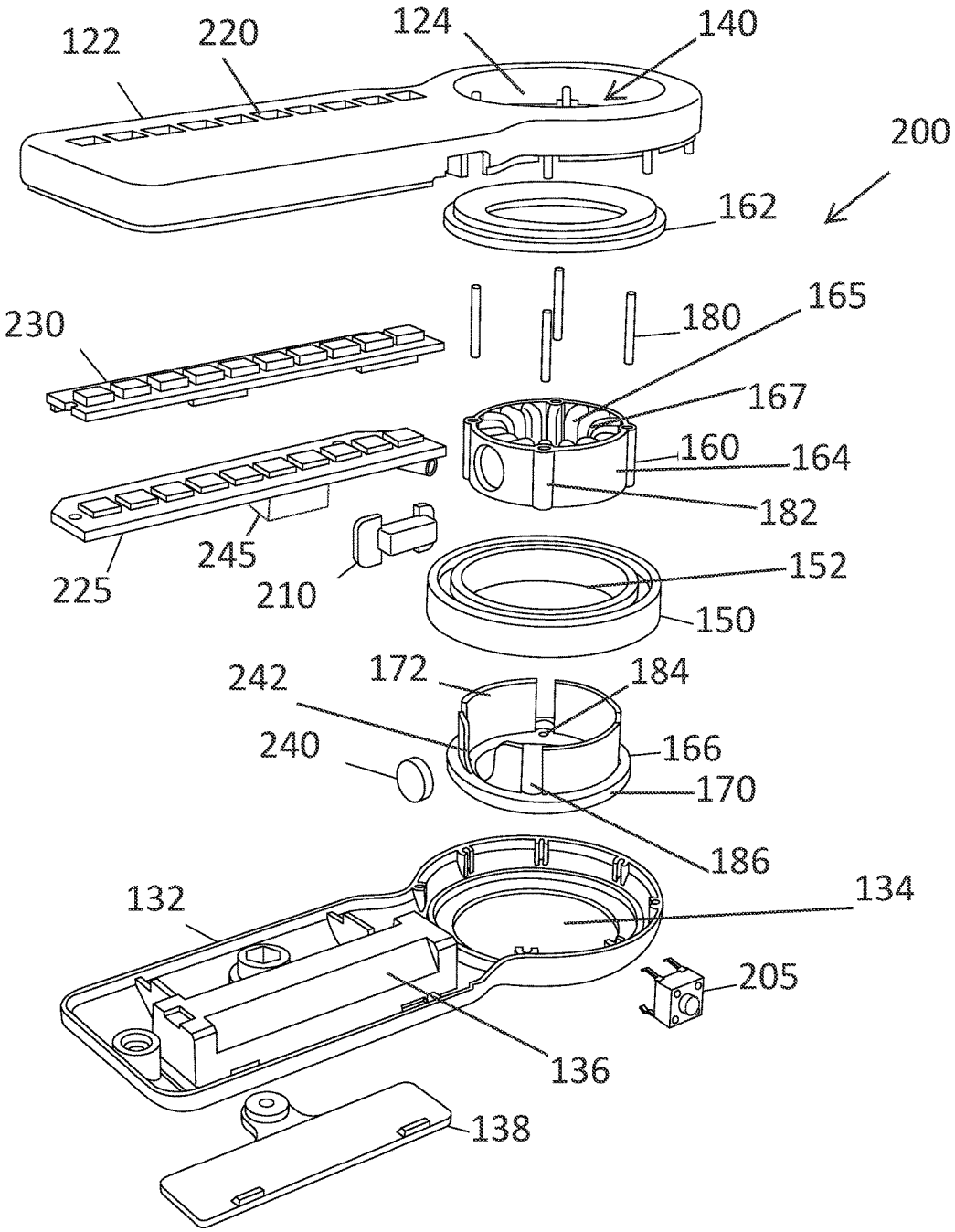
FIG. 3 is an exploded view of one representative embodiment of the invention with LED lights, wherein the annular finger gripping member is mounted within a ball bearing assembly.

FIG. 3 uses a similar construction to FIG. 2, as such like elements share like reference numbers. In this embodiment, the device 200 has a lower housing 132 includes a battery compartment 136 and removable battery door 138 to housing a replaceable battery. The battery acts as a counterweight, similar to FIG. 2. The power is turned on and off, with a switch 205 and a switch casing 210. In addition, the upper housing 122 include a plurality of apertures 220, situated in this embodiment along a single column. The plurality of apertures 220 are sized to fit or accommodate a plurality of LEDS 225. A plurality of light diffusers 230 may be positioned above the LEDs 225 in the apertures 220.

A magnet 240 may be positioned in a groove 242 on middle ring hub 166 such that rotation of the device is sensed by a computer chip or similar processing means 245 for various functionalities, such as for example activating battery power to the LED's, counting the number of or the speed of the revolutions, etc. Likewise, the magnet may be utilized to maintain animated visual effects in a fixed spatial orientation during use.

Figure 5C:
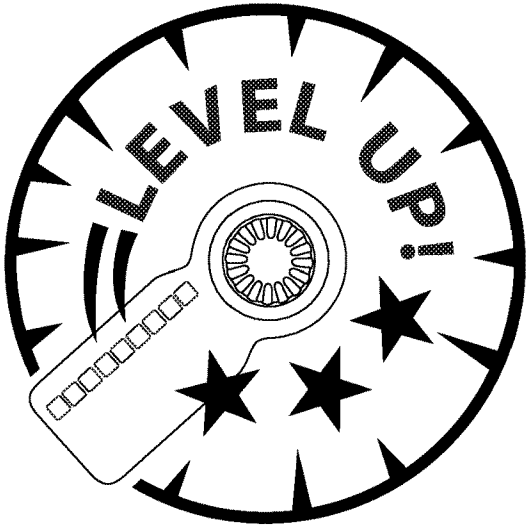
FIGS. 5A-5C are an illustration of possible light patterns and animations produced by rotation of the invention.
Figure 5B:
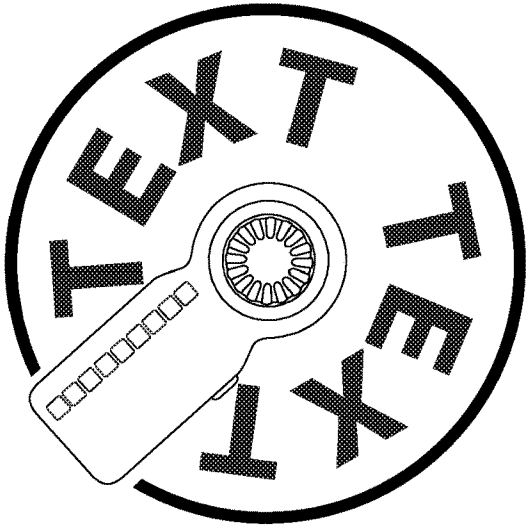
Figure 5A:
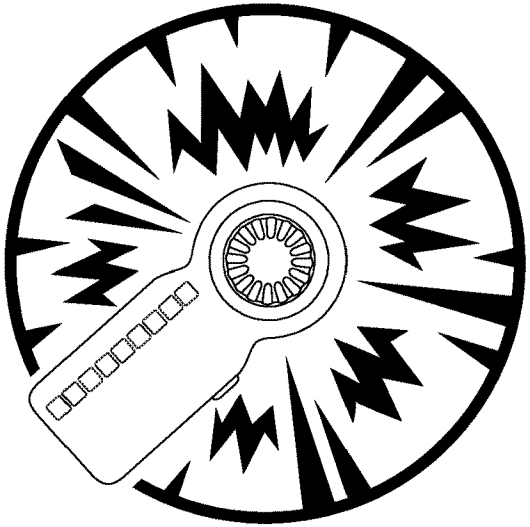

The device may be provided with different intelligence and communication levels. For example, the chip 245 may be programmed to alter the visible pattern produced by the LEDs after a predetermined amount of time, after a predetermined number of rotations or when a certain rotational velocity is reached. Various displays and animations of the light patterns or text may be programmed into the device, representative examples of such being shown in FIGS. 5A-5C.

An actuator or mode switch may also be provided to allow for user selection of different modes, such as for example animation graphics, LED color changes, revolution counting, and LED intensity changes, for unlocking new content, or creating new animations through a programmable mode wherein the user can select which LEDs are turned on or off.

Communication means, such as Bluetooth technology or the provision of a USB port, may provide connectivity to a Smartphone or computer for customizing or inputting new animation or functionalities into the device.

Figure 4B:
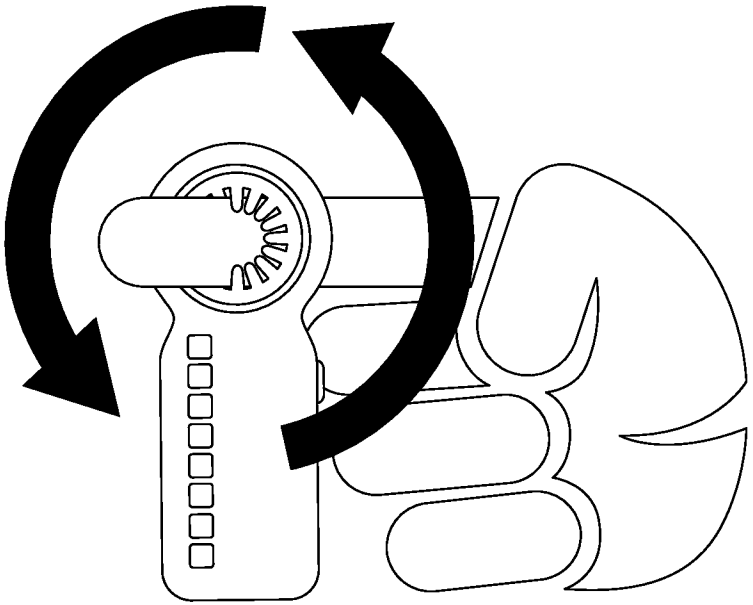
FIGS. 4A-4B are an illustration of an embodiment of the invention in use.
Figure 4A:
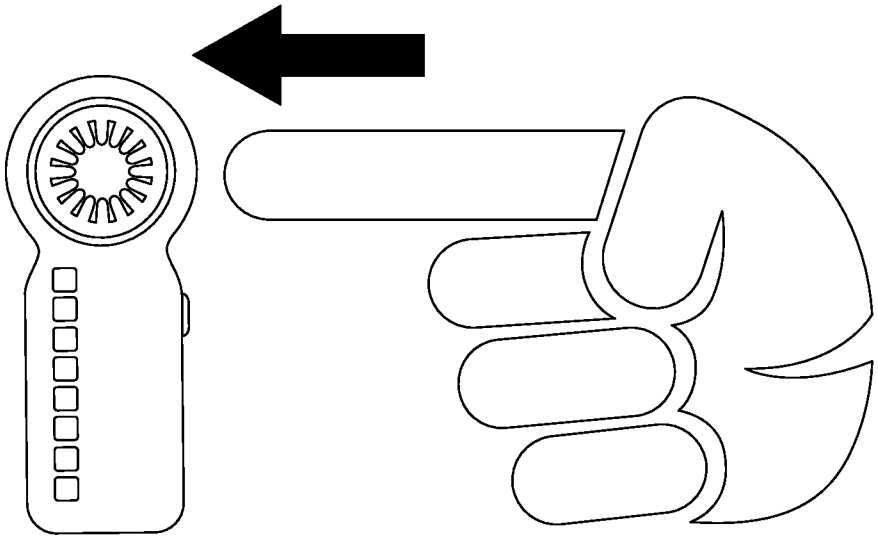

To utilize the device, as shown in FIGS. 4A and 4B, the user inserts his/her finger through the gripping member such that the device resides and is securely retained on the user's finger, such as between the two finger joints of the index finger. Flexing and compression of the finger gripping member ensures the device is not accidentally flung from the user's finger while spinning. The housing body is then caused to rotate or spin about the finger gripping member and finger, either by flicking the housing body with the other hand or moving the hand bearing the device in a circular manner. Rapid rotation of the housing body results in the LED's creating a visible two-dimensional light pattern, which remain unchanged, or which may change in color or shape over time, and which in some embodiments will present visible animated patterns or text, i.e., patterns or text that appear to move.

In summary for one embodiment there is a finger mounted spinning device comprising: (a) a housing body defined to have an elongated body extending oppositely to an opening positioned about one end of the housing body; (b) a finger ring assembly positioned within the opening of the housing body, the finger ring assembly having an inner ring and outer ring, and wherein the finger ring assembly is configured to cause rotation of the outer ring independently of the inner ring; (c) an aperture through the inner ring sized to receive a finger from a person's hand; (d) an annular finger gripping member positioned within the aperture of the annular finger ring hub to grip the finger from a person's hand; and (e) a weight is positioned elongated body.

In alternative embodiments, the elongated housing body may be a two-piece assembly, defined by an upper housing secured to a lower housing.

Alternatively, the finger ring assembly may further be defined as including: (j) a bearing casing secured about the opening positioned about one end of the housing body, and the bearing casing defining the inner ring and outer ring of the finger ring assembly; and (ii) an annular finger ring hub secured within the inner ring of the bearing casing, the annular finger ring hub has a middle ring hub configured to define the aperture to receive the finger from the person's hand. The embodiments may also define the annular finger ring hub as including a bottom ring hub that includes an outward extending shoulder and an upwardly extending skirt configured to capture the middle ring hub within the skirt and allow the bearing casing to rest on the outward extending shoulder. Alternatively, support pins may be positioned through shafts positioned around an outside of the middle ring hub and sitting in holes defined along the bottom ring hub includes holes and secured to a top ring hub. The shafts may further be positioned in channels cut into the upwardly extending skirt of the bottom ring hub.

In another embodiment, a finger mounted spinning device may include: (a) a housing body defined to have an elongated body extending oppositely to an opening positioned about one end of the housing body; (b) a finger ring assembly positioned within the opening of the housing body, the finger ring assembly having: (i) a bearing casing secured about the opening that is positioned about one end of the housing body, and the bearing casing defining an inner ring and an outer ring, the bearing casing being configured to cause rotation of the outer ring independently of the inner ring; (ii) an annular finger ring hub secured within the inner ring of the bearing casing and having an aperture sized to receive a finger from a person's hand; and (iii) an annular finger gripping member positioned within the aperture of the annular finger ring hub to grip the finger from a person's hand; and (c) a battery compartment positioned in the elongated body in communication with a power on/off switch accessible from outside of the elongated body; (d) a plurality of LEDs positioned for light visibility in the housing body and electrically controlled by a programmable circuit board housed in the elongated body; and (e) wherein, when the LEDs are activated, and the finger mounted spinning device is rotating.

As defined in this embodiment, the annular finger ring hub may be defined to have a top ring hub, a middle ring hub, and a bottom ring hub, and wherein the middle ring hub is configured to define the aperture that is sized to receive the finger from the person's hand.

The annular finger ring hub may further include a bottom ring hub that includes an outward extending shoulder and an upwardly extending skirt configured to capture the middle ring hub within the skirt and allow the bearing casing to rest on the outward extending shoulder.

The device may include support pins positioned through shafts positioned around an outside of the middle ring hub and sitting in holes defined along the bottom ring hub includes holes and secured to the top ring hub. The shafts may be positioned in channels cut into the upwardly extending skirt of the bottom ring hub.

In addition, the finger mounted spinning device may include a housing body that has a plurality of apertures, and the plurality of LEDs are aligned for light visibility through the plurality of apertures. The device may further include a magnet positioned in a groove defined on the middle ring hub and a sensor positioned on the elongated body such that rotation of the elongated body around the middle ring hub causes the sensor to activate preprogrammed lighting effects on the LEDs.

From the foregoing and as mentioned above, it is observed that numerous variations and modifications may be affected without departing from the spirit and scope of the novel concept of the invention. It is to be understood that no limitation with respect to the embodiments illustrated herein is intended or should be inferred. It is intended to cover, by the appended drawings provided, all such modifications within the scope of the invention.

We claim:

1. A finger mounted spinning device comprising:

a housing body defined to have an elongated body extending oppositely to an opening positioned about one end of the housing body;

a finger ring assembly positioned within the opening of the housing body, the finger ring assembly having an inner ring and outer ring, and wherein the finger ring assembly is configured to cause rotation of the outer ring independently of the inner ring;

an aperture through the inner ring sized to receive a finger from a person's hand;

an annular finger gripping member positioned within the aperture of the annular finger ring hub to grip the finger from a person's hand;

a weight is positioned elongated body, and wherein the finger ring assembly is further defined as including a bearing casing that is secured about the opening positioned about one end of the housing body, and the bearing casing defines the inner ring and outer ring of the finger ring assembly, and an annular finger ring hub secured within the inner ring of the bearing casing, the annular finger ring hub having a top ring hub, a middle ring hub and a bottom ring hub, wherein the middle ring hub being configured to define the aperture that receives the finger from the person's hand, and wherein the bottom ring hub being configured to include an outward extending shoulder and an upwardly extending skirt configured to capture the middle ring hub within the skirt and allow the bearing casing to rest on the outward extending shoulder, and support pins positioned through shafts that are positioned around an outside of the middle ring hub, the support pins sitting in holes defined along the bottom ring hub and further secured to the top ring hub.

2. The finger mounted spinning device of claim 1, wherein the shafts are positioned in channels cut into the upwardly extending skirt of the bottom ring hub.

3. A finger mounted spinning device comprising:

a housing body defined to have an elongated body extending oppositely to an opening positioned about one end of the housing body;

a finger ring assembly positioned within the opening of the housing body, the finger ring assembly having:

a bearing casing secured about the opening that is positioned about one end of the housing body, and the bearing casing defining an inner ring and an outer ring, the bearing casing being configured to cause rotation of the outer ring independently of the inner ring;

an annular finger ring hub secured within the inner ring of the bearing casing and having an aperture sized to receive a finger from a person's hand; and an annular finger gripping member positioned within the aperture of the annular finger ring hub to grip the finger from a person's hand;

a battery compartment positioned in the elongated body in communication with a power on/off switch accessible from outside of the elongated body;

a plurality of LEDs positioned for light visibility in the housing body and electrically controlled by a programmable circuit board housed in the elongated body;

wherein, when the LEDs are activated, and the finger mounted spinning device is rotating, and wherein the annular finger ring hub has a top ring hub, a middle ring hub, and a bottom ring hub, and wherein the middle ring hub is configured to define the aperture that is sized to receive the finger from the person's hand, wherein the annular finger ring hub further includes a bottom ring hub, the bottom ring hub includes an outward extending shoulder and an upwardly extending skirt configured to capture the middle ring hub within the skirt and allow the bearing casing to rest on the outward extending shoulder; and support pins positioned through shafts, the shafts are configured around an outside of the middle ring hub, the support pins further sit in holes defined along the bottom ring hub and secured to the top ring hub.

4. The finger mounted spinning device of claim 3, wherein the shafts are positioned in channels cut into the upwardly extending skirt of the bottom ring hub.

5. The finger mounted spinning device of claim 4, wherein the housing body includes a plurality of apertures, and the plurality of LEDs are aligned for light visibility through the plurality of apertures.

6. The finger mounted spinning device of claim 5, a magnet positioned in a groove defined on the middle ring hub and a sensor positioned on the elongated body such that rotation of the elongated body around the middle ring hub causes the sensor to activate preprogrammed lighting effects on the LEDs.

* * * * *